United States Patent [19]

Hasty

[11] Patent Number: 4,962,552

[45] Date of Patent: Oct. 16, 1990

[54] AIR-OPERATED BODY SUPPORT DEVICE

[76] Inventor: Charles E. Hasty, Box 185, Carrollton, Tex. 75006

[21] Appl. No.: 192,583

[22] Filed: May 9, 1988

[51] Int. Cl.[5] ..... A61G 7/057

[52] U.S. Cl. ..... 5/453; 5/455; 137/561 A; 137/883

[58] Field of Search ..... 5/453, 455, 469, 423, 5/449; 137/883, 561 A

[56] References Cited

U.S. PATENT DOCUMENTS

| | | | |
|---|---|---|---|
| 3,822,425 | 7/1974 | Scales . | |
| 3,909,858 | 10/1975 | Ducker . | |
| 4,099,276 | 7/1978 | Hunt et al. | 5/67 |
| 4,488,322 | 12/1984 | Hunt et al. | 5/453 |
| 4,525,885 | 7/1985 | Hunt et al. | 5/453 |
| 4,542,547 | 9/1985 | Sato | 5/453 |
| 4,638,519 | 1/1987 | Hess | 5/455 |
| 4,686,722 | 8/1987 | Swart | 5/453 |
| 4,694,520 | 9/1987 | Paul et al. | 5/453 |
| 4,711,275 | 12/1987 | Ford et al. | 5/453 |
| 4,722,105 | 2/1988 | Douglas | 5/453 |
| 4,745,647 | 5/1988 | Goodwin | 5/455 |
| 4,768,249 | 9/1988 | Goodwin | 5/453 |
| 4,797,962 | 1/1989 | Goode | 5/453 |
| 4,873,731 | 10/1989 | Williamson | 5/453 |
| 4,873,737 | 10/1989 | Savenide | 5/453 |

FOREIGN PATENT DOCUMENTS

| | | | |
|---|---|---|---|
| WO86/06624 | 11/1986 | PCT Int'l Appl. | 5/453 |
| WO88/09651 | 12/1988 | PCT Int'l Appl. | 5/453 |

OTHER PUBLICATIONS

Clinitron Brochure.
Monarch Brochure.
Flexicair Brochure.
KinAir Brochure.

*Primary Examiner*—Alexander Grosz
*Attorney, Agent, or Firm*—Ross, Howison, Clapp & Korn

[57] ABSTRACT

Airtight sacks are installed in parallel array to support a patient on a bed. A blower supplies air to the sacks through a function control valve system and a multi-tap high flow pressure selector. The pressure selector defines discrete zones of air pressure between its inlet and its exhaust to atmosphere. An adjustable tap communicating with each sack may be selectively placed in communication with any of the pressure zones to independently establish the pressure maintained in each sack. The sacks connect to the line from the pressure tape at a check valve connector. The function control valve system permits, in addition to normal operation, rapid inflation of the sacks, rapid pump-down of the sacks, and closing of the sacks to retain air pressure for transportation. A detector and indicator of the patient's depth of deflection is provided for at least one sack.

23 Claims, 3 Drawing Sheets

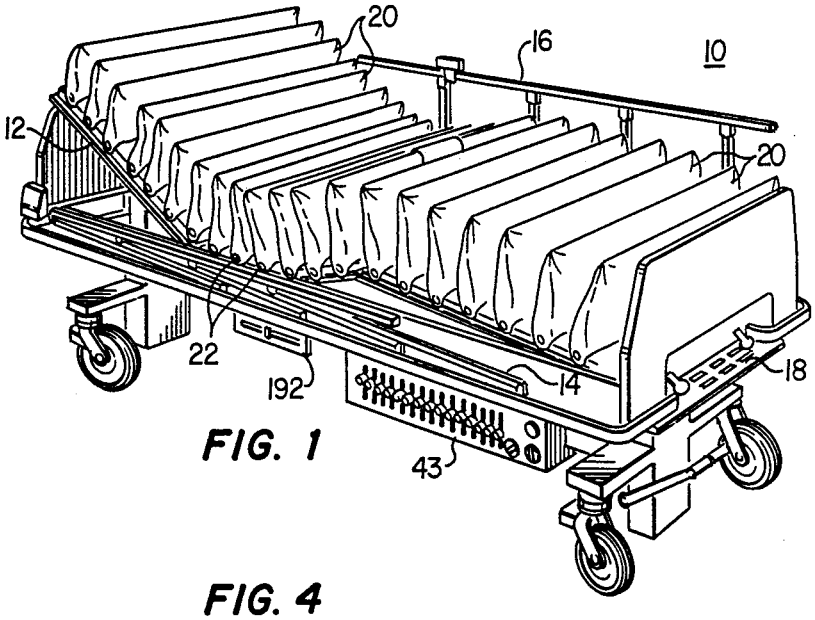
FIG. 1
FIG. 4
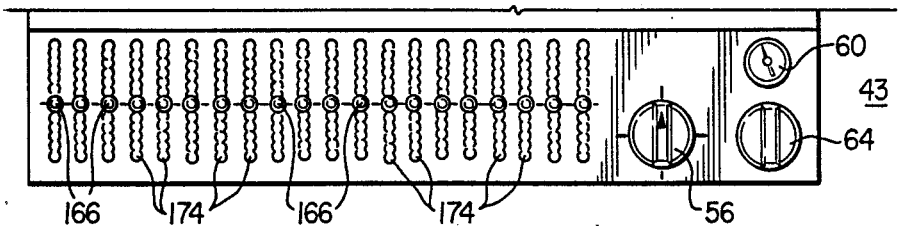
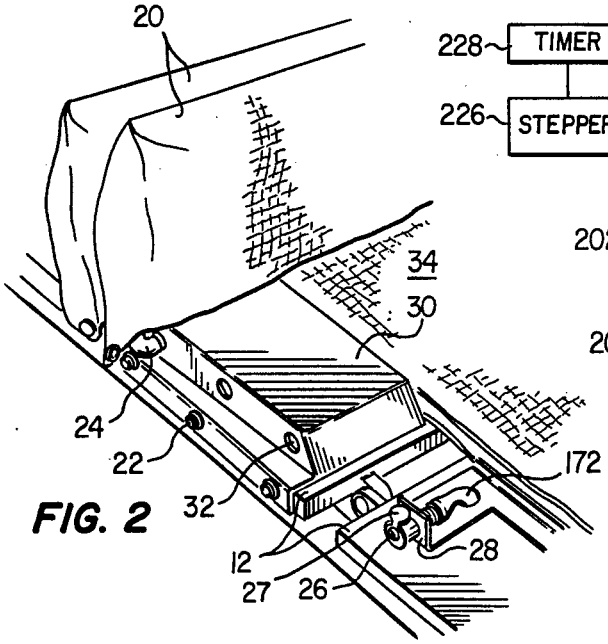
FIG. 2
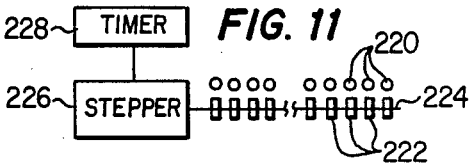
FIG. 11
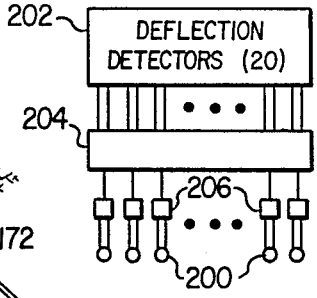
FIG. 10

| | NOR | CPR | MAX | TRAN |
|---|---|---|---|---|
| 44 | 0 | X | 0 | X |
| 46 | X | 0 | X | X |
| 48 | 0 | X | 0 | X |
| 50 | X | 0 | X | X |
| 52 | 0 | X | X | X |

AIR-OPERATED BODY SUPPORT DEVICE

FIELD OF THE INVENTION

This invention relates to body support devices utilizing inflatable air sacks, and has particular application to hospital beds for patients at risk to pressure sores.

BACKGROUND OF THE INVENTION

Much attention has been directed for many years to the design of reduced pressure patient support systems for maximizing patient comfort and reducing the complications of pressure sores in bedridden patients. One of the early widely used therapies in this field was a floatation system marketed under the trademark "CLINATRON." This device is a large tub containing an air permeable sack filled with micron-sized silicon spheres. The spheres are formed into a fluidized bed by massive introduction of air into the sack. This device marked the early stages of hospital rental equipment for patients at risk because of skin grafts, burns or pressure sores. The equipment was bulky and weighed almost one thousand pounds. An extremely large blower was required to effectuate the system, and any tears in the sack containing the silicon spheres could cause spheres to be blown out around the area of the apparatus. Despite its problems, and the great expense associated with utilization of the equipment, it has been widely used for patients at risk from excessive bed pressure.

In more recent years, a class of devices has been introduced which the industry has come to designate as "low air loss". A typical low air loss support system has a plurality of upstanding parallel vapor-permeable air sacks inflated to provide support for the patient. Such devices are marketed under the trademarks "Monarch,""Air Plus," "Flexicair," and "Kin Air". The approach of this class of equipment is to provide gradual leakage of air from the sacks, either by perforating them at selected locations or by providing a "breathable" sack material which is permeable to the passage of vapor. Typically, air is pumped from a manifold on one side of the bed through the sacks extending transversely of the bed. The air is wholly or partially exhausted through holes or pores in the sacks and at least in some instances, through an exhaust port. The air losses necessitate the use of a rather large air pump or blower, and the systems constructed of this type tend to be bulky and expensive. To seek to avoid infection problems stemming from the holes or open pores of the sack material, special sterilization precautions are necessary. The beds are not easily adaptable to ordinary hospital use and are not radiolucent so as to permit taking X-rays of a patient lying in one. This class of beds includes electrical circuitry making its use unacceptable in certain hospital environments. Because of their air loss characteristic, these beds cannot support the patient when blower operation is terminated. Thus, if the patient is to be transported to another hospital area, the sacks will be deflated unless battery power backup is provided. Despite their deficiencies, these beds have grown to dominate the market, which is predominantly served by the temporary leasing of these special purpose beds to hospitals as required for particular patients, generally at a rate to the hospital of about $100.00 per day. For reference, U.S. patents issued to makers of such commercial beds include U.S. Pat. Nos. 3,822,425, 3,909,858, 4,099,276, 4,488,322, 4,525,585 and 4,638,519.

Other simple approaches to providing reduced pressure patient support systems include water mattresses, air mattresses (including types with varying air pressure in alternating sections of the mattress) and egg-crate mattresses.

The utilization of the present invention is believed to present a substantial advance over the technology known in this industry. By providing an essentially zero air-loss system adapted to permit the clinician to carefully and quickly control the air pressure in all parts of the support system and to quickly carry out procedures required for care of the patient, the invention overcomes many of the problems of the art. The air sacks and electrical components of the system can quickly be installed or removed from a radiolucent intensive care bed. On removal, there are no electrical components remaining on the bed, and the bed may be utilized efficiently in ordinary hospital use. Because the invention does not utilize air sacks with holes or permeable pores, problems of infection and sterilization are minimized. The no-air loss approach permits the utilization of a much more compact air flow source. The end result is a system which is lightweight and relatively simple and inexpensive. The bed may be transported without air pump operation while still maintaining air pressure in the sacks to support the patient. The system is readily adaptable to automatic, time-varying rhythmic pressure variance therapies. It also may be adapted to automatic pressure control in feed back loops responsive to the weight and position of a patient.

SUMMARY OF THE INVENTION

In accordance with the invention, there is provided a body support device comprising a plurality of upstanding parallel elongated air sacks abutting to form a support surface, the material of the sacks being substantially impervious to the passage of air and other fluids. Each sack is provided with an inlet communicating with its interior, and all of the inlets are connected to an air flow production means to provide pressurized air to all of the sacks. Thus, each sack, in cooperation with the air flow production means, forms a support pressure system for the part of the person's body on the sack. Means are provided for independently selecting and establishing the pressure maintained in each sack, and for closing the pressure support systems to retain air pressure in the sacks.

In a further aspect, there are provided valve means to permit rapid switching of connections between the air flow production means and the sacks from a first state in which the inlet of the air flow production means communicates with atmosphere and the outlet communicates with the sack inlets to pressurize the sacks, and a second state in which the intake of the air flow production means communicates with the sack inlets and the outlet is vented to atmosphere, so that rapid pump down of the device may be achieved by causing the valve means to move to the second state.

Devices constructed in accordance with the invention may also include means for sensing the distance that the top of one of the air sacks is supporting the patient above a reference point, thus sensing the depth of the patient's deflection of the sack.

In a preferred form of the invention, each sack is free of every other sack, so that it may be removed from the array, and there is provided check valve means associated with the bed adjacent the sack inlet which is operable on removal of the sack to stop the flow of air at the check valve.

The invention contemplates that the means for independently selecting and establishing the pressure maintained in each sack may consist of a high flow conduit with an inlet connected to the outlet of the air flow production means. The conduit has discrete zones, each zone being maintained at a different pre-selected percentage of the inlet pressure. Means are provided for selectively connecting the inlet of each sack to a selected one of the zones.

Particularly adapted to the purpose of controlling the pressure in each sack independently is a multi-tap pressure selector having an inlet connected to the air flow source and a first block on one face of the selector having a plurality of channels, one of which is connected to the inlet. A second block on the opposite face of the selector also has a plurality of channels. A tap block interposed between the first and second blocks has a plurality of restricted passageways, each of which interconnects a different pair of channels on opposite sides of the selector. Each restricted passageway produces a pressure drop between the two channels of its interconnected pair. The channels and restricted passageways form a continuous sealed air flow conduit leading from the inlet, with each channel defining a zone of discrete and unique pressure. A plurality of pressure taps are slidably positioned in the tap block, each of the taps communicating with a different one of the air sacks. Each tap may be moved to selectively connect its air sack to any one of the channels in the first and second block, and thus to any selected one of the discrete pressure zones. The selector has an outlet connected to one of the air flow channels at the end of said air flow conduit remote from the inlet.

The advantages of the invention can be appreciated more fully by reference to the enclosed drawings which depict embodiments of the invention in more detail.

BRIEF DESCRIPTION OF THE DRAWINGS

FIG. 1 is an overall perspective view of a hospital bed to which the invention has been applied;

FIG. 2 is a partial perspective view illustrating the connection of the air sacks to the bed of FIG. 1, with some sacks and one connector cover plate removed;

FIG. 4 is an elevation of the pressure and function control panel of the bed of FIG. 1;

FIG. 10 is a schematic diagram of an automatic deflection detection-pressure setting feedback loop which can be used on the type of bed illustrated in FIG. 1; and FIG. 11 is a schematic diagram of a time-varying rhythmic control system for use on the type of bed illustrated in FIG. 1.

DETAILED DESCRIPTION

Figure 3:
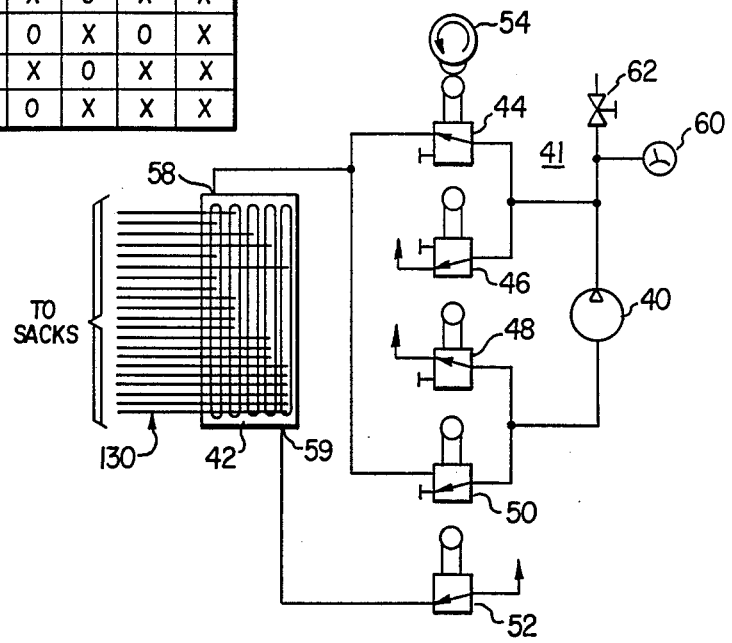
FIG. 3 is a schematic diagram of the air flow circuitry of the bed of FIG. 1, including function control valves and pressure selection.

A critical care hospital bed to which the invention has been applied is indicated by the reference numeral 10 in FIG. 1. Bed 10 includes a segmented platform 12 lying generally horizontally between folding side rails 14 and 16. The articulated segments of platform 12 are adjusted by a hydraulic system to various positions dictated by patient comfort or clinical considerations, including medical procedures to be carried out on the patient. The hydraulic adjustments are controlled by the clinician through a control panel 18 located at the foot of the bed. The bed is of a radiolucent character, meaning that there are no elements extending through the central area of a vertical projection of the patient lying in the bed which would interfere with the taking of x-rays of the patient. A bed having the general characteristics thus far described, which is appropriate for application of this invention, is a critical care bed marketed by Humanetics, Inc. of Carrollton, Tex. under the trademark "CardioSystems".

As depicted in FIG. 1, the ordinary mattress of bed 10 has been removed and replaced by an array of twenty air sacks 20 forming part of a body support system in accordance with this invention. The sacks 20 are fluid-tight, and are arranged in parallel array extending generally between the side rails 14 and 16. The sacks 20 are not perforated by sewing or any other means, so that the material's airtight characteristic is preserved. The sacks may be formed from any suitable impermeable material by heat sealing. One sack material preferred for the application of the invention is a nylon taffeta to the inside of which a heat sealable urethane coating is applied. Each sack 20 is independent and separate from every other sack in the array, so that it may be removed and/or replaced by itself. The sacks are held in position by a series of snaps 22 located along each side of platform 12.

As seen in FIG. 2, each sack is formed with an inlet 24 extending into the interior of the sack at one end thereof. An array of horizontally-oriented quick connection check valve couplings 26, each having a release lever 27, is spaced along the margin of the platform 12 in mounting brackets 28 adjacent to side rail 14, one corresponding to each of the sacks 20. The mating connector portion for the coupling is located on inlet 24 of each sack, so that each sack may be quickly provided with connection through a check valve to the air supply system of the bed described below. Check valve 26 and its complimentary connection portion associated with the inlet 24 may, for example, be the quick connect couplings marketed under the trade name "CPC" by Colter Products Company.

Only one check valve coupling 26 is illustrated in FIG. 2 for clarity of illustration, but the array of check valves corresponds on a one-to-one basis with the number of sacks provided in the system. A cover 30 is provided for each segment of platform 12 along the margin of the platform containing the check valve connectors 26. Cover 30 is provided with horizontal apertures 32 for access to each of the check valve connectors 26. Disconnection of sack inlet 24 from the check valve 26 may be quickly affected by raising inlet 24 to press lever 27 against the top of cover 30, releasing air sack 20 from the array and enabling the check valve 26 to stop all passage of air. Cover 30 minimizes the possibility of fluid spill interference with the connector's functioning.

In order to provide a level base for the sacks 20, and to provide some margin of comfort in the base of the bed at times when the support system is not functional, there is provided a foam pad 34 approximately equal to the height of covering 30 covers the remainder of platform 12.

FIG. 3 schematically illustrates the manner in which sacks 20 are interconnected in a system in accordance with the invention to provide easily controlled support for the body. The major operative elements of the system are an airflow production source such as air pump or blower 40, a function control valve system 41, a high flow multi-tap pressure selector 42, and the array of sacks 20.

The function control valve system 41 and pressure selector 42 are, as will be seen, compact units which can be installed underneath bed platform 12 along one edge of the bed behind control panel 43. Blower 40 may be very compact and placed in a portable box (not shown) to be removably hung under the bed and connected to the function control valve system 41. A suitable method of connection is by a quick disconnect arrangement of sliding confronting plates having a pair of ports on each plate. The ports on the box are associated with the inlet and outlet of the blower 40, and are matched to the two ports communicating with system 41. System 41 includes five on/off valves, 44, 46, 48, 50, and 52. Valves 44–52 may be operated by a single control shaft carrying a series of five cams such as the one indicated at numeral 54, to operate the valves between their on and off positions. The cams 54 may be controlled by the clinician utilizing function control knob 56 on the control panel 43, shown in FIG. 4, to turn this shaft. Although cam operation of the valves is a convenient and simple one for construction and use, other valve activation mechanisms may be employed, including solenoids. Valve 44 blocks or enables communication between the positive or outlet side of pump 40 and inlet 58 of the pressure selector 42. Valve 46 gates 5 the connection between the pump outlet and atmosphere. Valve 48 provides on/off connection between the negative side or inlet of pump 40 and atmosphere. Valve 50 is also connected to the inlet of pump 40, and provides on/off communication with the inlet 58 of selector 42. Valve 52 simply permits connection of the outlet 59 of selector 42 to atmosphere. Function control system 41 also includes a pressure gauge 60 and a bleed valve 62 permitting the outlet side of pump 40 to be selectively bled to atmosphere by the setting of weight selection knob 64 located on control panel 43 as shown in FIG. 4. This setting establishes the pressure at selector inlet 58.

Figure 5:
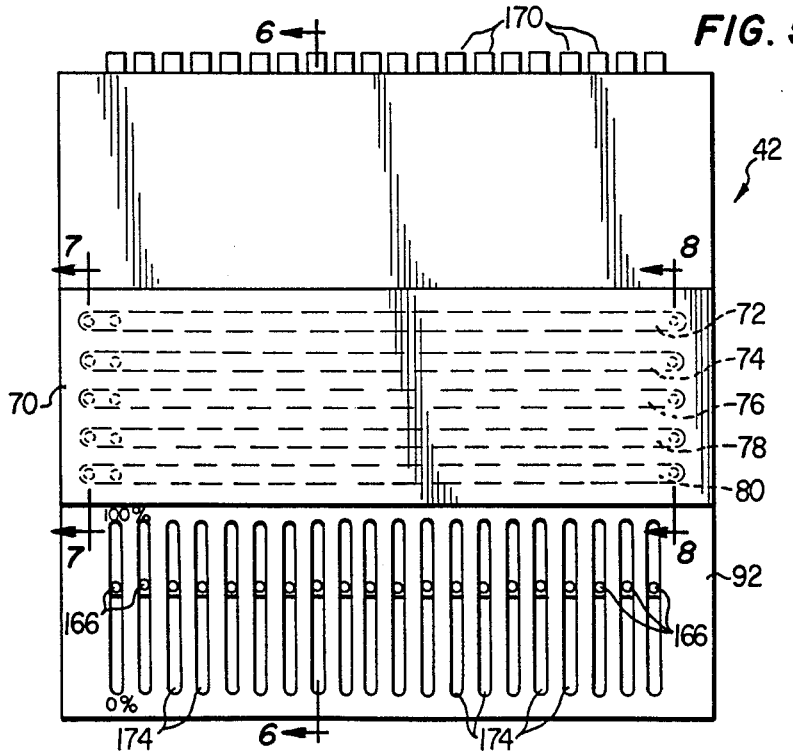
FIG. 5 is a plan view illustrating the high flow multi-tap pressure selector of the bed of FIG. 1.
Figure 6:
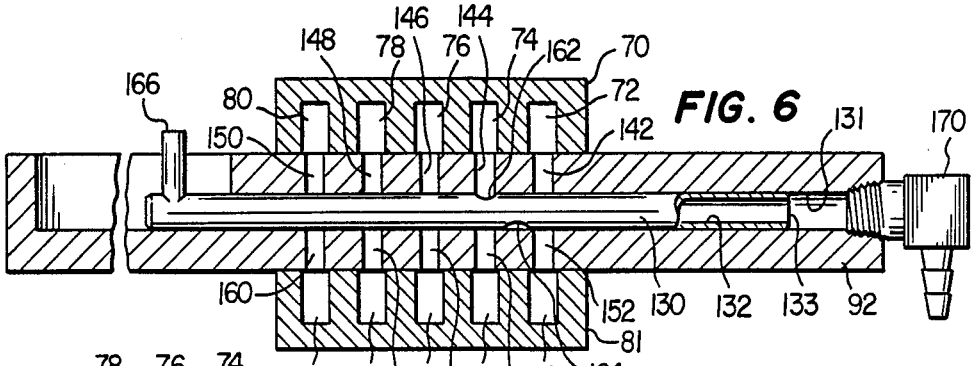
FIG. 6 is a sectional view along line 6—6 in FIG. 5.
Figure 7:
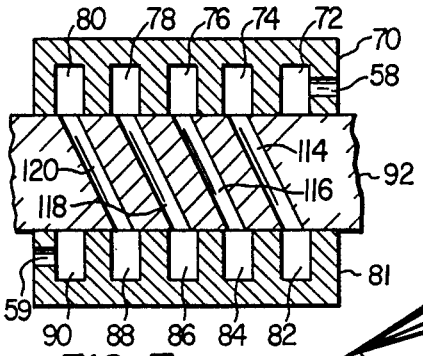
FIG. 7 is a sectional view along line 7—7 in FIG. 5.

The structure and operation of pressure selector 42 is best understood in conjunction with FIGS. 5–7. Selector 42 includes a front block 70 having a series of channels 72, 74, 76, 78 and 80 formed in the rear face thereof. Channel 72 is the high pressure entrance plenum communicating with selector inlet 58. A rear block 81 is formed substantially identically to the front block 70. Channels 82, 84, 86, 88 and 90 formed in the face of block 81 confront, but are spaced from, the channels 72–80 of block 70. Interposed between block 70 and block 81 is a tap block 92 which is sealingly engaged with blocks 70 and 81 by suitable means such as gaskets (not shown).

Figure 8:
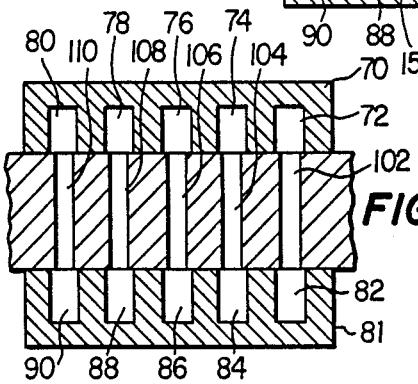
FIG. 8 is a sectional view along line 8—8 in FIG. 5.

Channel 72, which communicates with selector inlet 58 at one end thereof (FIG. 7), communicates at the opposite end (FIG. 8) through restricted passageway 102 with its corresponding channel 82 in the rear block 81. Likewise, at that same end, as seen in FIG. 8, channels 74 and 84 are connected by restricted passageway 104; channels 76 and 86 are connected by restricted passageway 106; channels 78 and 88 are connected by restricted passageway 108; and channels 80 and 90 are connected by restricted passageway 110. The ends of certain channels of the first and second blocks 70 and 81 are also interconnected at section 7—7 by slanted passageways, as indicated in FIG. 7. Restricted passageway 114 connects channels 82 and 74; restricted passageway 116 connects channels 84 and 76; restricted passageway 118 connects channel 86 to channel 78; and restricted passageway 120 passes between channel 88 and channel 80. The end of channel 90 at the cross-section taken in FIG. 7 communicates in turn with outlet 59 from the selector 42. It will be appreciated that the circuitry thus defined in blocks 70 and 81 together with the tap block 92, is a sealed airflow conduit extending from the selector inlet 58 to outlet 59. The conduit passes through the length of each channel 72–90 in series, with a restricted passageway providing communication across tap block 92 between each channel in the series. Each restricted passageway, by its restricted size in comparison to the flow cross-section of the channels themselves, provides a pressure drop between each of the ten sections of the flow conduit. Thus, each of the ten channels defines a unique pressure which is a preselected percentage of the inlet pressure, with pressures declining from channel 72 to channel 90. A suitable restriction size is established depending on the desired balance between two competing characteristics: (1) smaller size will increase the maximum pressure available to the system; and (2) larger size will increase flow rates and thus decrease the time required to inflate or deflate the sacks.

The pressure zones defined in the channels of blocks 70 and 81 may be communicated with individual 5 ones of the air sacks 20 by means of a series of pressure taps 130 carried in shafts 131 in tap block 92. A tap 130 and shaft 131 are provided to correspond with each sack 20. A representative tap 130 and shaft 131 are shown in FIG. 6. Tap 130 is formed with a bore 132 extending through the tap from its upper end 133. The shaft 131 may be sealed toward its top and bottom by O-rings (not shown). A series of tapping ports communicates between each shaft 131 and each channel of blocks 70 and 81. Shaft 131 is connected to channels 72, 74, 76, 78, 80, 82, 84, 86, 88 and 90 by tapping ports 142, 144, 146, 148, 150, 152, 154, 156, 158 and 160, respectively. An orifice 162 is formed in the wall of tap 160 facing the series of tap ports 152–160. A second orifice 164 in the opposite side of tap 130 faces the series of tap ports 142–150. Orifices 162 and 164 are on diametrically opposed sides of the tap 130, and are axially spaced from one another by one-half the distance between adjacent tapping ports in the series 142–150 or 152–160. In this way, as tap 130 is axially moved, the user may expose the central bore 132 for communication with any one of the ten channels defined in blocks 70 and 81. In the apparatus depicted, manual movement is enabled by horizontally extending lever 166 located near the lower end of tap 130. Each tapping shaft 131 communicates adjacent end 133 of tap 130 to a fitting 170. Fitting 170 of each tap is connected by hose 172 to one of the check valves 26 mounted on the bed platform 12.

Reference is now made to the valve position table illustrated in FIG. 3. The control shaft 54 has four different positions defining different combinations of open and closed states for the five valves 44–52. These 5 combinations are shown in the table. In normal operation, valves 44, 48 and 52 are open, while valves 46 and 50 are closed. Air is taken into the pump through open valve 48, and pumped to selector inlet 58 via open valve 44. It passes through the 10 pressure zones of the selector 42 and out open valve 52. Each tap 130 is adjusted to cause its corresponding sack to maintain the pressure of a selected one of the zones. Individual adjustment of pressure in one sack by manipulating one of the taps 130 has no long term effects on the pressure of the other sacks and only minimal transient effects.

A second functional position of control shaft 54 is a rapid pump down or deflation of the air sacks 20 denominated as "CPR", as rapid deflation may be desired for the emergency administration of CPR. In this functional setting, each of the valves assumes the opposite state from that which it maintains during normal setting, so that the pump positively pumps down the sacks. The third functional setting is maximum inflate, which is to rapidly fill all of the air sacks in the system. This may be desired simply to set up the system or may be called for by radiographic procedures. In this functional setting, all valves except for valve 52 are in their normal operational state. On maximum inflate, valve 52 closes the exhaust port 59 from selector 42. Finally, the fourth functional setting is the transportation mode, which implies the cessation of airflow production in the system. In this mode, all valves are closed to preserve air pressure in the sacks. In the three non-normal function settings, it is possible that the blower could be run air-starved. Suitable protection to prevent harm to the blower, as by a time or temperature cut-off or relief valve, may be provided.

Referring to FIG. 4, it can be seen that a readily understandable control panel 43 is mounted on one side of the bed in front of selector 42 and function control system 41. The left hand portion of the panel includes the twenty individual tap levers 166 mounted for vertical sliding movement to produce the axial movement of each tap 130. By manual adjustment of each lever, each individual air sack may be communicated to a different one of the pressure zones in pressure selector 42. Preferably, the tracks 174 guiding levers 166 are provided with ten detent positions corresponding to each of the ten axial positions of each tap.

At the right end of panel 43, the function control knob 56 permits the clinician to place the system into any one of the four functional modes. Pressure gauge 60 reflects the pressure generated at the outlet of the pump, as regulated by the setting of bleed valve 62.

Figure 9:
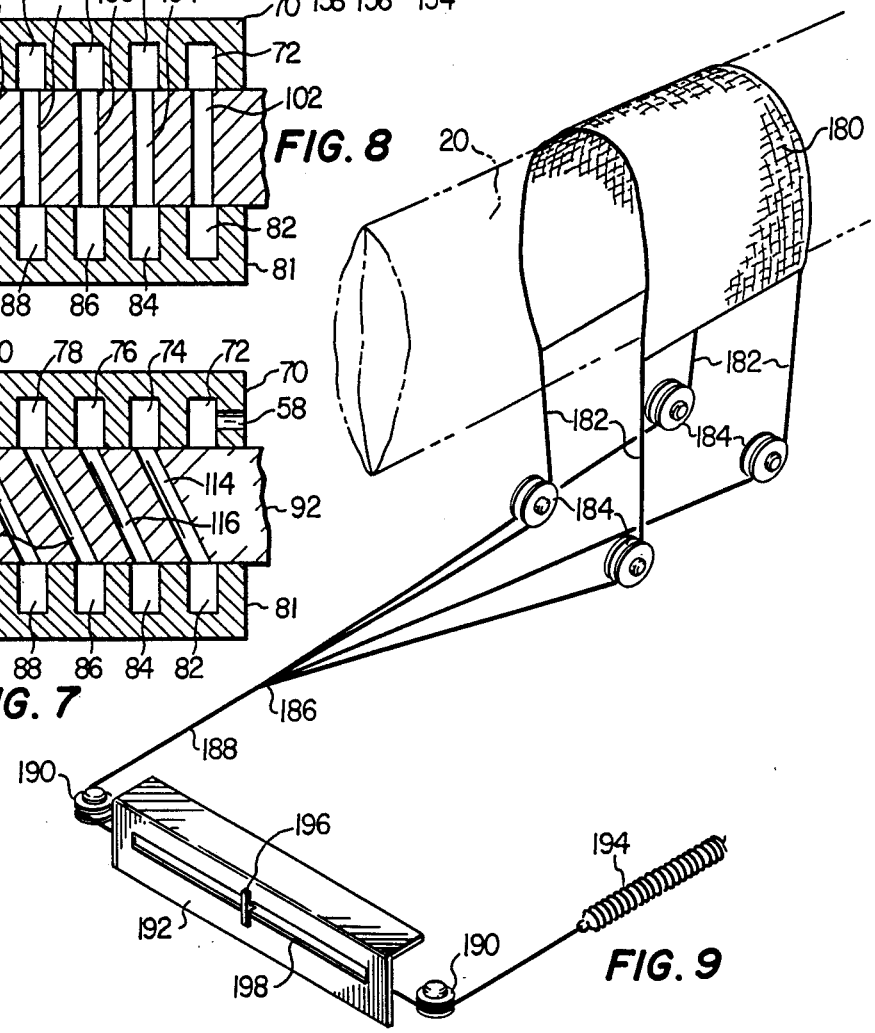
FIG. 9 is a schematic view of the deflection depth indicator of the bed of FIG. 1.

The setting of weight selector 64 to control bleed valve 62 is further enabled by the deflection indicator system schematically illustrated in FIG. 9. A central sack 20 in the array is provided with a rectangular sheet 180 stretched across its upper surface. Four cords 182 extend downwardly from sheet 180 over pulleys 184 to a common point of joinder 186 to cord 188. The common cord 188 is guided by indicator pulleys 190 behind an indicator scale 192 mounted on the side of the bed. Tension is provided to cords 182 and 188, to hold sheet 180 firmly to the sack 20, by spring 194. Cord 188 carries a pointer 196 which slides in a slot 198 in scale 192. This guides the clinician in adjusting the overall system pressure by turning weight selection knob 64 to change the setting of bleed valve 62. The adjustment is made until the pointer 196 is in the central range of scale 192, indicating sufficient pressure to maintain the patient well above the platform 12, but sufficient softness to enjoy the benefits of low pressure support.

Of course, for any given air pressure in the sacks, a heavier person will sink deeper in the sacks than a lighter one. Little or no penetration would mean that the weight of the patient is being supported by a minimum contact area, maximizing contact pressure. By reducing air sack pressure and permitting the contact area to increase, the contact pressure is reduced. Eventually, the contact area is maximized by pressure reduction, and further pressure reduction will produce no additional benefit. The scale 192 and pointer 196 should be aligned so that the central range of indication is in the zone of maximized contact area.

While adjustment of pressure at selector inlet 56 by adjusting weight selector knob 64 has been illustrated to effect proper patient depression of the sacks, other structural techniques may be used. For example, by providing valves 44–52 with continuous adjustment capability between their "on" and "off" states, and by modifying cam 54, the bleed valve 62 can be eliminated and the adjustment be performed by manipulation of the function selector knob 56 in a range around the normal function setting. The cams 54 would be configured to gradually move valves 44–52 between their normal functional states and their opposite states as the knob 56 is turned from "normal" to "CPR". This gradually reduces the pressure at selector inlet 58. The cam 54 controlling valve 52 would gradually increase the restriction of valve 52, as knob 56 moves from "normal"to "maximum", thus increasing the pressure at 58.

Other forms of detecting and indicating the depth of the patient's deflection may be used. For example, an ultrasonic emitter/sender may be mounted below a sack 20 in the center of platform 12. Reflected energy signals returning to the platform 12 can be detected to ascertain the depth of the patient's depression of the top of the sack. Such a system producing electrical data signals could be used in a feedback loop to automatically control the overall system pressure, as by adjusting bleed valve 62.

The system of this invention is readily adapted to automatic pressure control modalities. A multiple feedback control system for the individual pressure taps is schematically illustrated in FIG. 10. The individual pressure taps 200 are set in response to signals from individual deflection detectors 202 mounted with each sack, such as ultrasonic emitter/sensors described above. The signals from each detector 202 are sent individually to a processor 204 which controls individual stepper 206 for adjusting each tap 200. Each signal is continuously compared by processor 204 to a desired value for the particular sack, and any error signal generated causes the processor to activate the particular stepper 206 corresponding to the detector causing the signal. Stepper 206 moves tap 200 in a direction to minimize the error signal.

Although this multiple feed-back system is optimally operated on deflection signals, it will be appreciated that individual sack pressures could be sensed to produce the error signals. The pressure to be maintained in a sack to produce the desired range of deflection, however, will vary from patient to patient. A pressure sensing system should have as its base line desired pressure a value which is established after observing the patient in position.

This invention may also be utilized in a system for producing time-varying rhythmic pressure therapies, as schematically illustrated in FIG. 11. Rhythmic variation in pressures, with each individual sack passing through a range of available pressure with the passage of time, is often desired and can be easily accomplished by the system of this invention. Taps 220 are adjusted by individual cams 222 on cam shaft 224 driven by stepper 226 under the control of timer 228. By selection of cam shape and timing of stepper commands, the clinician can vary the pressures in individual portions of the bed as desired.

It will be appreciated from the foregoing description that many benefits and advantages flow from application of this invention to the hospital environment. Adjustment of the pressure taps gives a quick way of independently establishing the desired firmness or softness in each supporting sack. Adjustment of one tap does not cause variations in the pressure of other sacks. The system can be quickly switched from normal function to rapid deflation or pump-down. The device can be deprived of its air flow operation and still support the patient with an air cushion. The elimination of passage of air or other vapor through the sacks reduces the risks of infection and simplifies cleaning and sterilization. The fastening of sacks to bed is done with connectors concealed from the hazards of fluid spills. The sack connectors permit removal of any sack without compromising the integrity of the air circuit.

The sacks and blower box may be readily removed to permit use as an ordinary bed, eliminating the necessity for a single use rental bed which is costly and of limited versatility. The air flow circuitry components are compact and do not compromise the radiolucent characteristics of the bed. The system is adaptable to automatic control of pressures including control in response to deflection detection as well as time-varying rhythmic pressure adjustment.

Although specific embodiments of the invention have been illustrated in the accompanying drawings and described in the foregoing detailed description, it will be understood that the invention is not limited to the embodiments disclosed, but is capable of numerous rearrangements, modifications and substitutions of parts and elements without departing from the spirit of the invention.

I claim:

1. A body support device adapted to placement on a bed frame, comprising:

(a) a plurality of parallel air sacks, each extending substantially the width of the frame to form a support surface for a person, the material forming the sacks being substantially impervious to the passage of air and other fluids, each having only one inlet located at one end thereof;

(b) air flow production means connected to provide pressurized air to all of said inlets, whereby each sack, in cooperation with the air flow production means, forms a support pressure system for the part of the person's body supported by the sack;

(c) means for selecting and establishing the pressures maintained in the sacks;

(d) valve means operable between at least three states: a first state wherein the sack inlets communicate with the outlet of the air flow production means, a second state in which the sacks inlets communicate with atmosphere so as to expel the air contained in the sacks, and a third state in which the sack inlets are closed to air flow to retain air pressure in the sacks whereby the bed may be moved while maintaining air support of the person lying thereon; and (e) a single mode selector for user control of the valve means comprising a mechanical switch manually operable to move the valve means between the said three states.

2. The device of claim 1, in which the said second state of the valve means connects the sack inlets to atmosphere by their connection to the intake of the air flow production means whereby rapid pump-down of the device may be achieved by causing said valve means to move to the second state.

3. The device of claim 1, further comprising means for sensing, with respect to at least one sack, the distance the top of that sack is supporting the patient above a reference point, thereby sensing the depth of the patient's deflection of the sack.

4. The device of claim 1, wherein each sack is not bound to any other sack, so that it is free to be removed from the array, and further comprising separate check valve means between each sack inlet and the air flow production means operable on removal of any sack for stopping the flow of air at the check valve associated with that sack.

5. The device of claim 1, wherein the means for selecting and establishing the pressures maintained in the sacks comprises:

(a) a conduit having an inlet connected to the outlet of the air flow production means;

(b) means providing discrete zones in the conduit, each zone being maintained at a different preselected pressure which is a preselected percentage of inlet pressure; and (c) means for selectively connecting the inlets of the sacks to selected ones of the zones in the conduit.

6. The device of claim 5, wherein the conduit is connected to atmosphere through a valve which may be adjusted to establish the inlet pressure.

7. A body support device comprising:

(a) a plurality of air sacks forming a support surface for a person, each sack having at least one inlet;

(b) air flow production means connected to provide pressurized air flow accessible to all of the inlets, whereby each sack, in cooperation with the air flow production means, forms a support pressure system for the part of the person's body supported by the sack;

(c) means for selecting and establishing the pressures maintained in the sacks comprising a plurality of adjustable taps connected to particular sacks for accessing the air flow;

(d) valve means to permit rapid switching of connections between the air flow production means and sacks from a first state in which the intake of the air flow production means communicates with atmosphere and the air flow production means outlet communicates with the sack inlets to pressurize the sacks, and a second state in which the intake of the air flow production means communicates with the sack inlets and the air flow production means outlet is vented to atmosphere, whereby rapid pump-down of the device may be achieved by causing said valve means to move to the second state; and (e) a mode selector for user control of the valve means comprising a mechanical switch for moving the valve means between the first and second states.

8. The device of claim 7, further comprising means for sensing, with respect to at least one sack, the distance the top of that sack is supporting the patient above a reference point, thereby sensing the depth of the patient's deflection of the sack.

9. The device of claim 7, wherein each sack is not bound to any other sack, so that it is free to be removed from the array, and further comprising separate check valve means between each sack inlet and the air flow production means, operable on removal of any sack for stopping the flow of air at the check valve associated with that sack.

10. The device of claim 7, wherein the means for selecting and establishing the pressures maintained in the sacks comprises;

(a) a conduit having an inlet connected to the outlet of the air flow production means;

(b) means providing discrete zones in the conduit, each zone being maintained at a different pressure which is a preselected percentage of inlet pressure; and (c) means for selectively connecting the inlets of the sacks to selected ones of the zones in the conduit.

11. The device of claim 10, wherein the conduit is connected to atmosphere through a valve which may be adjusted to establish the inlet pressure.

12. For use with a body support device having a plurality of air sacks having inlets and abutting to form a support surface for a person, and air flow production means connected to provide pressurized air to all of said inlets, whereby each sack, in cooperation with the air flow production means, forms a support pressure system for the part of the person's body supported by the sack; a control valve for independently selecting and establishing the pressure maintained in each sack, comprising:

(a) a conduit having an inlet connected to the outlet of the air flow production means;

(b) means providing a plurality of zones in the conduit, each zone being maintained at a different preselected percentage of inlet pressure; and (c) means for selectively connecting the inlet of the sacks to selected ones of the zones in the conduit.

13. The device of claim 12, wherein the conduit is connected to atmosphere through a valve which may be adjusted to establish the inlet pressure.

14. The device of claim 12, further comprising valve means to permit rapid switching of connections between the air flow production means and sacks from a first state in which the intake of the air flow production means communicates with atmosphere and the air flow production means outlet communicates with the sack inlets to pressurize the sacks, and a second state in which the intake of the air flow production means communicates with the sack inlets and the air flow production means outlet is vented to atmosphere, whereby rapid pump-down of the device may be achieved by causing said valve means to move to the second state.

15. A body support device comprising:

(a) a plurality of air sacks forming a support surface for a person, each sack being substantially air tight and having an air inlet;

(b) a single air blower connected to provide a continuous flow of pressurized air of different pressure levels simultaneously available to all of the sack inlets; and (c) pressure selection means connected to the air blower for establishing and maintaining a desired array of pressures among the sacks, adapted to permitting adjustment of pressures for particular sacks without affecting the pressures maintained in the other sacks in the device, the pressure selection means including a plurality of adjustable taps connected to particular sacks for selectively engaging different pressure levels established by the blower.

16. The device of claim 15, wherein the pressure selection means comprises:

(a) a conduit having an inlet connected to the outlet of the air blower and a plurality of zones each being maintained at a different percentage of the blower outlet pressure; and (b) a plurality of taps for selectively connecting the inlets of the sacks to selected ones of the zones in the conduit.

17. The device of claim 16, wherein the conduit zones are separated by flow restrictions.

18. The device of claim 16 further comprising a control valve for adjusting the inlet pressure of the pressure selection means.

19. The device of claim 15, further comprising valve means operable between at least three states: a first state wherein the sack inlets communicate with the air blower through the pressure selector, a second state in which the sack inlets communicate with atmosphere to permit air expulsion from the sacks, and a third state in which the sack inlets are closed to air flow to retain air pressure in the sacks.

20. The device of claim 15, further comprising means for sensing, with respect to at least one sack, the distance that the top of the sack is supporting the patent above a reference point.

21. The device of claim 20, further comprising feedback means for controlling the pressure selection means in response to the output of the sensing means.

22. A body support device comprising:

(a) a plurality of air sacks forming a support surface for a person, each sack having an air inlet;

(b) air flow production means connected to provide pressurized air to the sack inlets; and (c) a variable pressure conduit having an inlet connecting to the outlet of the air flow pressure production means and an outlet connected to atmosphere, with decreasing pressure in the conduit between the inlet and the outlet; and (d) a plurality of pressure taps for connecting the sacks to the variable pressure conduit, each tap being adjustable so that it is selectively connectable to the conduit at areas of different pressure over the range between inlet pressure and outlet pressure.

23. The device of claim 22, further comprising means for adjusting the inlet pressure of the variable pressure conduit.

* * * * *